US011703273B1

(12) United States Patent
Karl et al.

(10) Patent No.: US 11,703,273 B1
(45) Date of Patent: Jul. 18, 2023

(54) REFRIGERATOR AND STORAGE SYSTEM FOR A REFRIGERATOR

(71) Applicant: WHIRLPOOL CORPORATION, Benton Harbor, MI (US)

(72) Inventors: Jackson Felipe Karl, Stevensville, MI (US); Anup R. Khandekar, Pune (IN); Kailash More, Pune (IN); Nilesh Zanwar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/691,436

(22) Filed: Mar. 10, 2022

(51) Int. Cl.

| | |
|---|---|
| ***F25D 25/02*** | (2006.01) |
| ***F25D 23/06*** | (2006.01) |
| ***A47B 88/975*** | (2017.01) |
| ***A47B 88/90*** | (2017.01) |
| *A47B 88/41* | (2017.01) |

(52) U.S. Cl.
CPC ..... *F25D 25/025* (2013.01); *A47B 88/90* (2017.01); *A47B 88/975* (2017.01); *F25D 23/069* (2013.01); *A47B 88/41* (2017.01); *A47B 2210/175* (2013.01)

(58) Field of Classification Search
CPC ..... A47B 88/975; A47B 88/41; A47B 88/90; A47B 2210/175; F25D 25/025; F25D 25/005; F25D 23/069
See application file for complete search history.

(56) References Cited

U.S. PATENT DOCUMENTS

| | | | | |
|---|---|---|---|---|
| 5,269,600 | A | 12/1993 | Arreola et al. | |
| 9,207,011 | B2 * | 12/2015 | Song | F25D 23/069 |
| 10,240,856 | B2 * | 3/2019 | Park | F25D 17/065 |
| 10,408,532 | B1 * | 9/2019 | Wantland | F25D 23/069 |
| 10,451,339 | B1 * | 10/2019 | Wantland | F25D 23/069 |
| 10,966,524 | B2 * | 4/2021 | Wang | F25D 25/025 |
| 11,519,665 | B2 * | 12/2022 | Wei | F25D 23/069 |
| 2015/0069066 | A1 * | 3/2015 | Choi | F25D 25/022 220/533 |
| 2020/0196754 | A1 * | 6/2020 | Wang | F25D 25/025 |
| 2021/0341218 | A1 * | 11/2021 | Wei | F25D 25/025 |

FOREIGN PATENT DOCUMENTS

| | | | | |
|---|---|---|---|---|
| CN | 102462224 B | * | 6/2014 | A47B 88/487 |
| CN | 206410424 U | | 8/2017 | |
| EP | 3835697 A1 | | 6/2021 | |
| KR | 20150062662 A | * | 6/2015 | F25D 23/069 |
| KR | 102174511 A | | 7/2015 | |
| WO | WO-2019165518 A1 | * | 9/2019 | A47B 88/975 |

* cited by examiner

*Primary Examiner* — Kimberley S Wright
(74) *Attorney, Agent, or Firm* — Brooks Kushman P.C.

(57) ABSTRACT

A refrigerator drawer includes a front wall, a rear wall, first and second opposing sides walls, an adjustable partition wall, and first and second rollers. The front and rear walls define first and second slots, respectively. The first and second opposing sides walls each extend between the front and rear walls such that the front, rear wall, and side walls define an internal storage space. The partition wall is disposed within the storage space. The partition wall has first and second ends extending outward and through the first and second slots, respectively. The first and second rollers are attached to the first and second ends on opposing sides of the front and rear walls, respectively. The first and second rollers are configured to roll along exterior surfaces of the front wall and rear wall, respectively, to adjust distances between the partition wall and the side walls.

18 Claims, 7 Drawing Sheets

REFRIGERATOR AND STORAGE SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator drawer includes a front wall, a rear wall, first and second opposing side walls, a bottom wall, a divider, and first and second rollers. The first and second opposing sides walls extend between the front and rear walls. The front wall and the rear wall define first and second slots, respectively. Each of the first and second slots extend between the first and second side walls. The bottom wall is interconnected with the front wall, rear wall, first side wall, and second side wall. The divider extends between the front and rear walls. The divider has a first surface facing the first side wall, a second surface facing the second side wall, first and second opposing ends disposed proximate to the front and rear walls, respectively, and first and second protrusions extending outward from the first and second ends and through the first and second slots, respectively. The first and second rollers are attached to the first and second protrusions, respectively. The first and second rollers are configured to glide and roll along exterior surfaces of the front wall and rear wall, respectively, between the first and second opposing sides walls. The first and second rollers are also configured to engage the exterior surfaces of the front wall and rear walls, respectively, to maintain a substantially perpendicular alignment of the divider relative to the front and rear walls.

A refrigerator drawer includes a front wall, a rear wall, a first side wall, a second side wall, a divider wall, and first and second rollers. The front wall defines a first slot. The rear wall is spaced apart from the front wall and defines a second slot that is substantially parallel with the first slot. The first side wall extends between a first end of the front wall and a first end of the rear wall. The second side wall is spaced apart from the first side wall and extends between a second end of the front wall and a second end of the rear wall. The divider wall extends between the front and rear walls. The divider wall has first and second protrusions extending outward and through the first and second slots, respectively. The first and second rollers are attached to the first and second protrusions, respectively. The first and second rollers are configured to roll along exterior surfaces of the front wall and rear wall, respectively, between the first and second opposing sides to adjust distances between the divider wall and the first and second side walls.

A refrigerator drawer includes a front wall, a rear wall, first and second opposing sides walls, an adjustable partition wall, and first and second rollers. The front wall defines a first slot. The rear wall is spaced apart from the front wall and defines a second slot. The first and second opposing sides walls each extend between the front and rear walls such that the front wall, rear wall, first side wall, and second side wall define an internal storage space. The adjustable partition wall is disposed within the internal storage space. The adjustable partition wall has first and second ends extending outward and through the first and second slots, respectively. The first and second rollers are attached to the first and second ends on opposing sides of the front and rear walls relative to a central portion of the adjustable partition wall, respectively. The first and second rollers are configured to roll along exterior surfaces of the front wall and rear wall, respectively, between the first and second opposing side walls to adjust distances between the adjustable partition wall and the first and second side walls.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
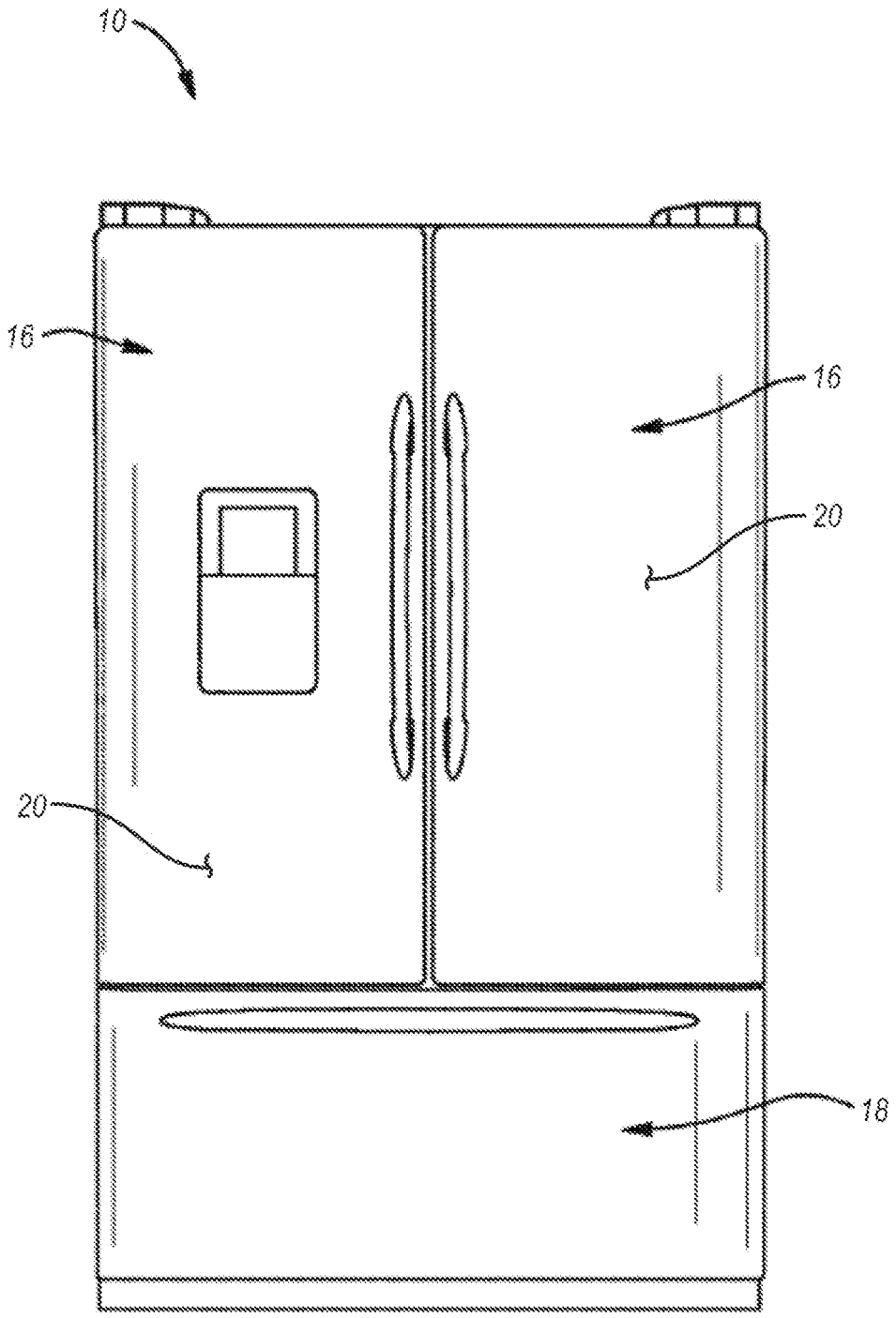
FIG. 1 is an elevated front view of a French-Door Bottom Mount type refrigerator appliance.
Figure 2:
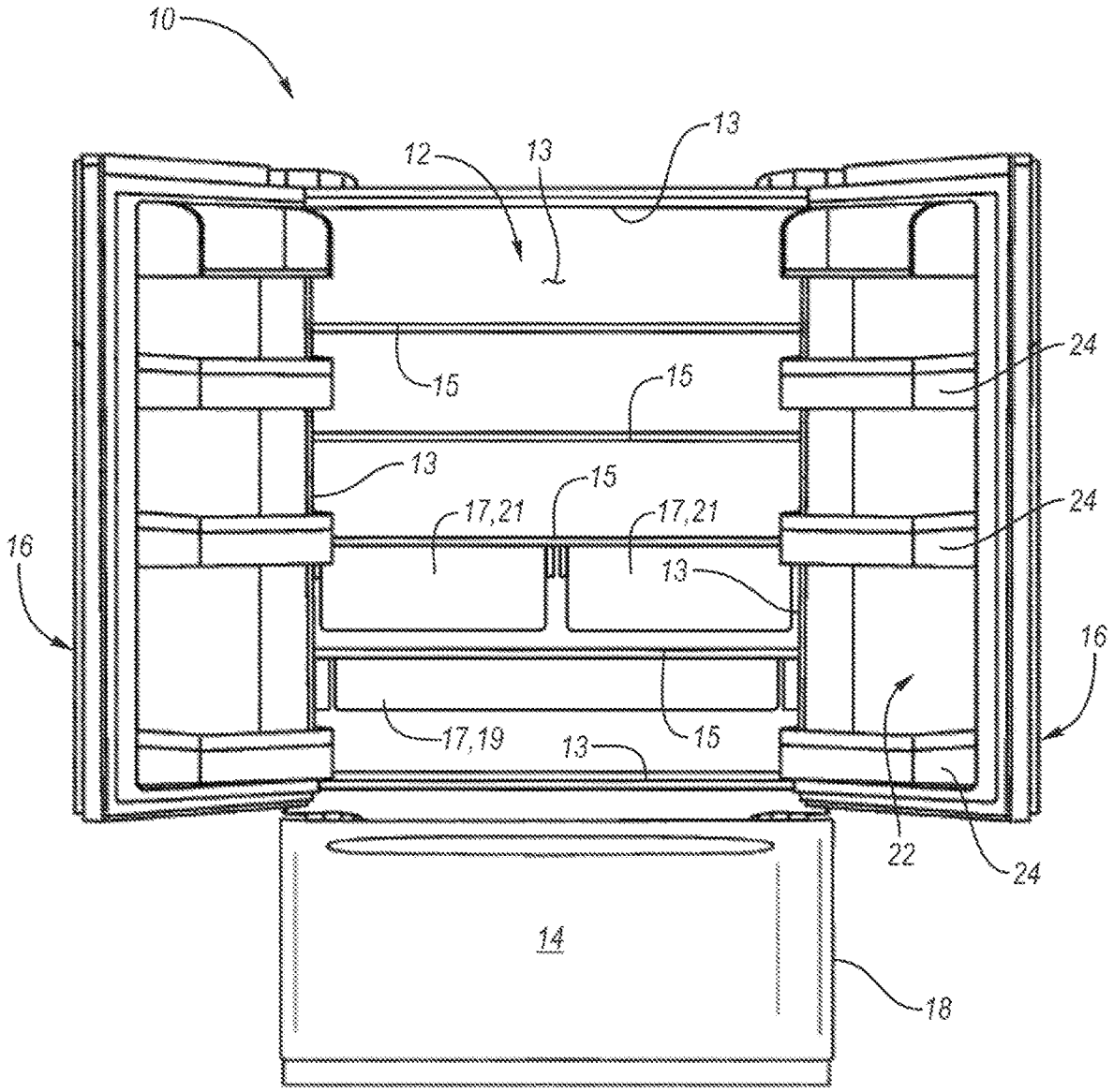
FIG. 2 is an elevated front view of a French-Door Bottom Mount type refrigerator with the refrigerator compartment doors open.
Figure 3:
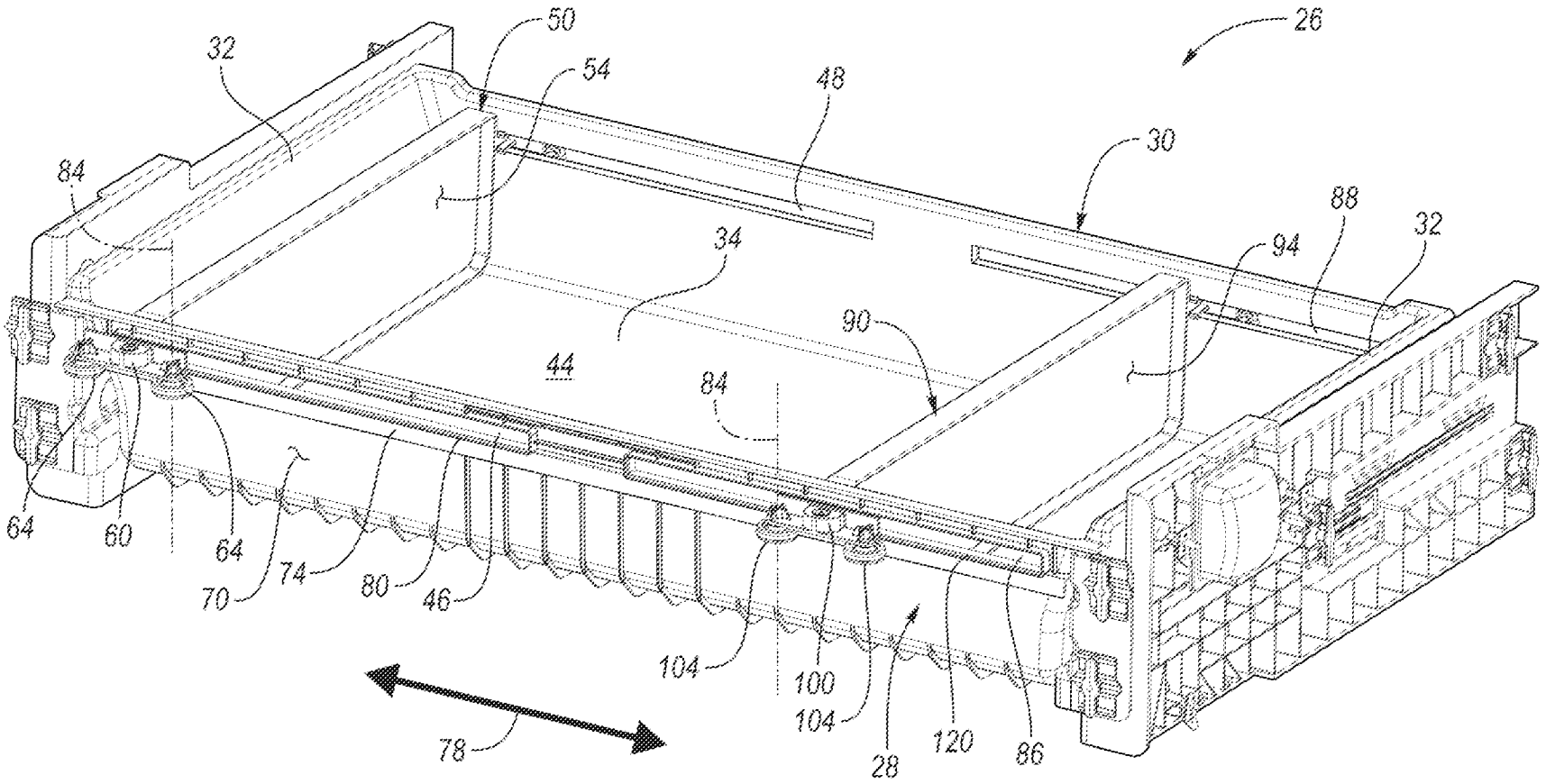
FIG. 3 is a front isometric view of refrigerator drawer that is disposed within a compartment of the refrigerator.
Figure 4:
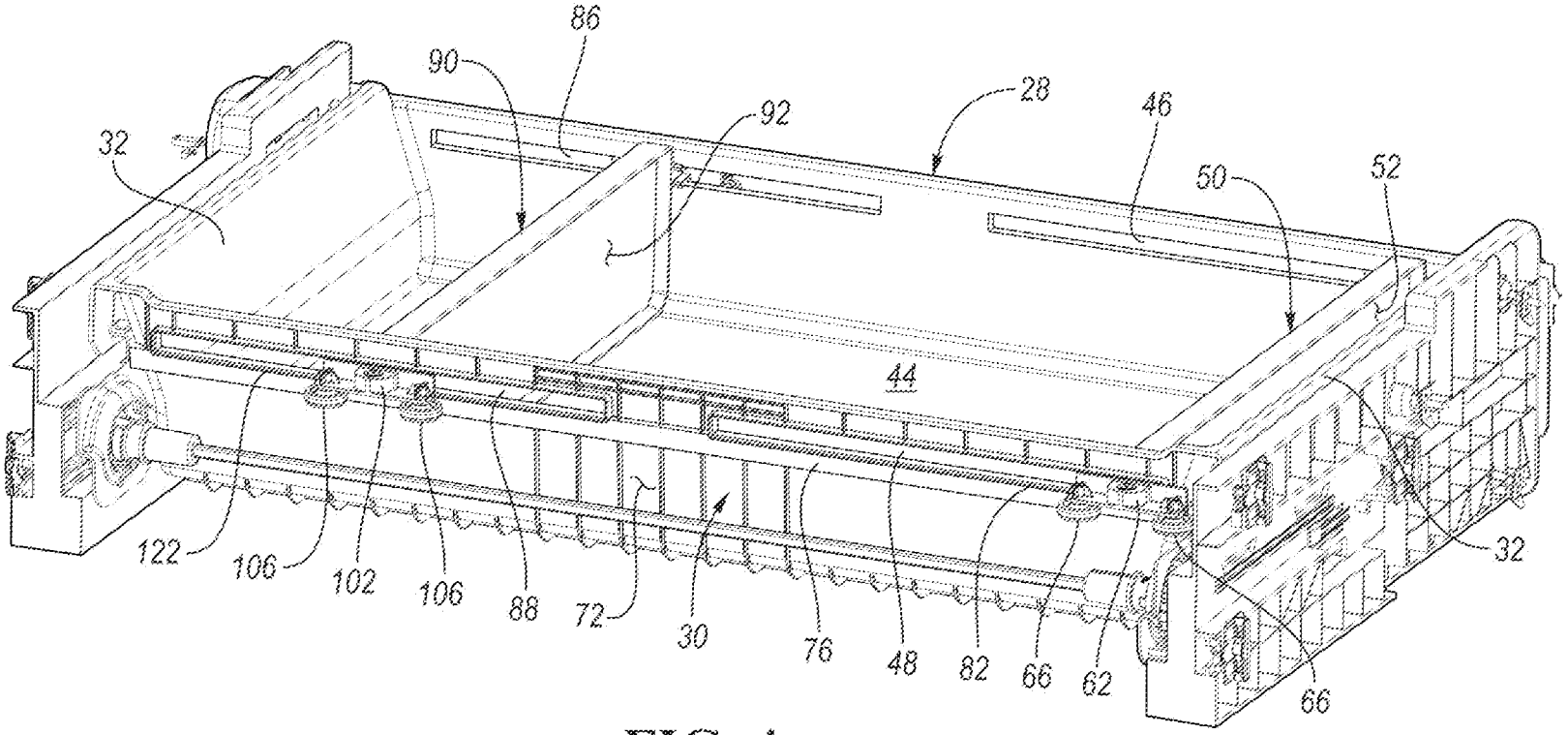
FIG. 4 is a rear isometric view of refrigerator drawer.
Figure 5:
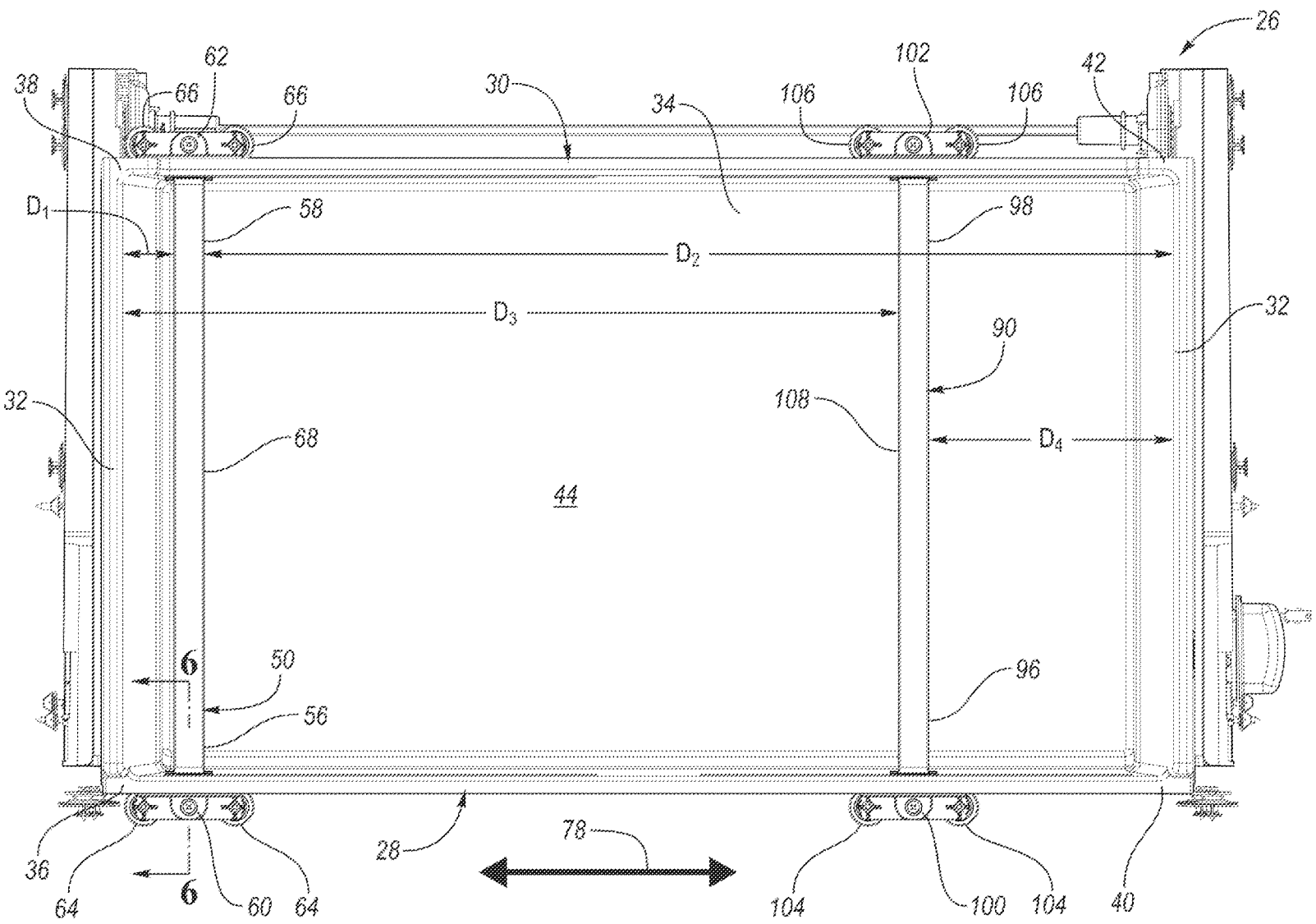
FIG. 5 is a top view of the refrigerator drawer.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes panels or walls 13 that form a housing and define the fresh food compartment 12 and the freezer compartment 14. The walls 13 may more specifically form an internal liner of the refrigerator 10. The walls 13 may include a rear or back wall, a top wall, a bottom wall, and two side walls.

One or more shelves 15 may be secured to the walls 13 within the fresh food compartment 12. One or more drawers 17 may be slidably secured to the shelves 15 or the walls within the fresh food compartment 12. More specifically, the drawers 17 may be slidably secured to the shelves 15 or the walls within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-6, a refrigerator drawer 26 is illustrated. The refrigerator drawer 26 may be representative of any of the drawers 17 illustrated in FIGS. 1 and 2, including pantry drawer 19 and crisper drawers 21. Furthermore, the drawer 26 may be representative of a drawer that is disposed within the freezer compartment 14. The refrigerator drawer 26 includes a front wall 28, a rear wall 30, opposing side walls 32, and a bottom wall 34. The opposing side walls 32 may be referred to as the first and second side walls or the first and second opposing side walls. The front wall 28 is spaced apart from the rear wall 30. The first of the side walls 32 is spaced apart from the second of the side walls 32.

The opposing side walls 32 each extend between and are connected to the front wall 28 and the rear wall 30. The first of the side walls 32 may more specifically extend between and may be connected to each of a first end 36 of the front wall 28 and a first end 38 of the rear wall 30. The second of the side walls 32 may more specifically extend between and may be connected to each of a second end 40 of the front wall 28 and a second end 42 of the rear wall 30. The bottom wall 34 is interconnected with the front wall 28, rear wall 30, and opposing side walls 32. The front wall 28 and the rear wall 30 may be substantially parallel to each other and may be substantially perpendicular to each of the opposing side walls 32. The opposing side walls 32 may be substantially parallel to each other. The bottom wall 34 may be substantially perpendicular to the front wall 28, rear wall 30, and opposing side walls 32. Substantially parallel may refer to any incremental angle that is between exactly parallel and 15° from exactly parallel. Substantially perpendicular may refer to any incremental angle that is between exactly perpendicular and 15° from exactly perpendicular. The front wall 28, rear wall 30, opposing side walls 32, and bottom wall 34 define an internal storage space 44 of the drawer 26.

The front wall 28 defines a first slot 46 and the rear wall 30 defines a second slot 48. The first slot 46 and the second slot 48 extend between the opposing side walls 32. The first slot 46 may be substantially parallel to the second slot 48.

Substantially parallel may refer to any incremental angle that is between exactly parallel and 15° from exactly parallel.

A divider 50 is disposed with the internal storage space 44 of the drawer 26. The divider 50 may more specifically be a divider wall or a partition wall. The divider 50 is configured to partition the internal storage space 44 into smaller spaces or sub-compartments. The divider 50 extends between the front wall 28 and the rear wall 30. The divider 50 has a first surface 52 that faces the first of the side walls 32 and a second surface 54 that faces the second of the side walls 32. The divider 50 has a first end 56 and a second end 58 that are disposed proximate to the front wall 28 and rear wall 30, respectively. The first end 56 and the second end 58 may be referred to as the first and second opposing ends.

The divider 50 further includes a first protrusion 60 and a second protrusion 62 extending outward from the first end 56 and the second end 58, respectively. The first protrusion 60 and the second protrusion 62 may also be referred to as first and second projections or extensions. Furthermore, the first protrusion 60 and the second protrusion 62 may form the first end 56 and the second end 58, respectively, or may form portions of the first end 56 and the second end 58, respectively. The first protrusion 60 and the second protrusion 62 also extend outward through the first slot 46 and the second slot 48, respectively. The first protrusion 60 and the second protrusion 62 and slidable within the first slot 46 and the second slot 48, respectively, such that a position of the divider 60 within the internal storage space 44 is adjustable. More specifically, the first protrusion 60 and the second protrusion 62 are slidable within the first slot 46 and the second slot 48, respectively, such that (i) a distance, $D_1$, between the divider 50 and the first of the side walls 32 and (ii) a distance, $D_2$, between the divider 50 and the second of the side walls 32 is adjustable.

A first set of rollers 64 and a second set of rollers 66 are rotatably secured to the first protrusion 60 and the second protrusion 62, respectively. Each of the first set of rollers 64 and the second set of rollers 66 may include two rollers. Alternatively, a single roller may be secured to the first protrusion 60 and the second protrusion 62. The first protrusion 60 (or a portion of the first protrusion 60) and the first set of rollers 64 are disposed on an opposing side of the front wall 28 relative to a central portion 68 of the divider 50. The second protrusion 62 (or a portion of the second protrusion 62) and the second set of rollers 66 are disposed on an opposing side of the rear wall 30 relative to the central portion 68 of the divider 50. If each of the first set of rollers 64 and the second set of rollers 66 includes two rollers, the two rollers of the of the first set of rollers 64 may straddle the divider 50 at or along the first protrusion 60 and the two rollers of the of the second set of rollers 66 may straddle the divider 50 at or along the second protrusion 62.

Each roller of the first set of rollers 64 is configured to glide and roll along an outwardly facing surface or exterior surface 70 of the front wall 28 between the first and second opposing sides walls 32 in order to adjust (i) the position of the divider 50 within the internal storage space 44, (ii) the distance, $D_1$, between the divider 50 and the first of the side walls 32, and (iii) the distance, $D_2$, between the divider 50 and the second of the side walls 32. Each roller of the second set of rollers 66 is also configured to glide and roll along an outwardly facing surface or exterior surface 72 of the rear wall 30 between the first and second opposing sides walls 32 in order to adjust (i) the position of the divider 50 within the internal storage space 44, (ii) the distance, $D_1$, between the divider 50 and the first of the side walls 32, and (iii) the distance, $D_2$, between the divider 50 and the second of the side walls 32.

A first rail 74 protrudes outward from the exterior surface 70 of the front wall 28 and a second rail 76 protrudes outward from the exterior surface 72 of the rear wall 30. The first rail 74 and the second rail 76 each extend and are elongated in a direction 78 that extends between the opposing side walls 32. The first rail 74 is configured to guide the first set of rollers 64 along the exterior surface 70 of the front wall 28 between the opposing side walls 32. Stated in other terms, the first set of rollers 64 are configured to roll along or over the first rail 74 in the direction 78 that extends between the opposing side walls 32. The second rail 76 is configured to guide the second set of rollers 66 along the exterior surface 72 of the rear wall 30 between the opposing side walls 32. Stated in other terms, the second set of rollers 66 are configured to roll along or over the second rail 76 in the direction 78 that extends between the opposing side walls 32.

Each roller of the first set of rollers 64 is configured to engage the exterior surface 70 of the front wall 28 and each roller of the second set of rollers 66 is configured to engage the exterior surface 72 of the rear wall 30 to maintain a substantially perpendicular alignment of the divider 50 relative to the front wall 28, rear wall 30, and bottom wall 34. A first ridge 80 protrudes outward from the exterior surface 70 of the front wall 28 and a second ridge 82 protrudes outward from the exterior surface 72 of the rear wall 30. The first ridge 80 overhangs the first set of rollers 64 and the second ridge 82 overhangs the second set of rollers 66 such the tops of the first set of rollers 64 and tops of the second set of rollers 66 are restricted from reorienting by the first ridge 80 and second ridge 82, respectively. Stated in other terms, each roller of the first set of rollers 64 and each roller of the second set of rollers 66 are configured to rotate about axes 84 that are substantially perpendicular to the bottom wall 34. The first set of rollers 64 and the second set of rollers 66 are configured to engage the first ridge 80 and second ridge 82, respectively, so that the axes 84 axes remain in an orientation that is substantially perpendicular to the bottom wall 34. It is further noted that the divider 50 has a substantially perpendicular alignment to the front wall 28, rear wall 30, and bottom wall 34 and that the engagement of the first set of rollers 64 with the first ridge 80 and the engagement of the second set of rollers 66 with the second ridge 82 facilitates maintaining the substantially perpendicular alignment of the divider 50 to the front wall 28, rear wall 30, and bottom wall 34. Substantially perpendicular may refer to any incremental angle that is between exactly perpendicular and 15° from exactly perpendicular Including two rollers in each of the first set of rollers 64 and the second set of rollers 66 also prevents twisting of the divider 50 within the first and second slots 46, 48 and prevents one of the first end 56 or the second end 58 of the divider 50 from moving along direction 78 without the other of the first end 56 and the second end 58 also moving along direction 78. This arrangement also facilitates maintaining the substantially perpendicular alignment of the divider 50 to the bottom wall 34. This arrangement further facilitates maintaining a substantially perpendicular alignment of the divider 50 to the front wall 28 and rear wall 30, and a substantially parallel alignment of the divider 50 to the opposing side walls 32. Substantially parallel may refer to any incremental angle that is between exactly parallel and 15° from exactly parallel. Substantially perpendicular may refer to any incremental angle that is between exactly perpendicular and 15° from exactly perpendicular.

The front wall 28 may further define a third slot 86 and the rear wall 30 may further define a fourth slot 88. The third slot 86 and the fourth slot 88 extend between the opposing side walls 32. The third slot 86 may be substantially parallel to the fourth slot 88. The third slot 86 and the fourth slot 88 may also be substantially parallel to the first slot 46 and the second slot 48. All the slots (i.e., the first slot 46, second slot 48, third slot 86, and fourth slot 88) may be positioned at the same height from the bottom wall 34. Substantially parallel may refer to any incremental angle that is between exactly parallel and 15° from exactly parallel.

A second divider 90 is disposed with the internal storage space 44 of the drawer 26. The second divider 90 may more specifically be a divider wall or a partition wall. The second divider 90 is configured to further partition the internal storage space 44 into smaller spaces or sub-compartments. The second divider 90 extends between the front wall 28 and the rear wall 30. The second divider 90 has a first surface 92 that faces the first of the side walls 32 and a second surface 94 that faces the second of the side walls 32. The second divider 90 has a first end 96 and a second end 98 that are disposed proximate to the front wall 28 and rear wall 30, respectively. The first end 96 and the second end 98 may be referred to as the first and second opposing ends.

The second divider 90 further includes a first protrusion 100 and a second protrusion 102 extending outward from the first end 96 and the second end 98, respectively. The first protrusion 100 and the second protrusion 102 may also be referred to as first and second projections or extensions. Furthermore, the first protrusion 100 and the second protrusion 102 may form the first end 96 and the second end 98, respectively, or may form portions of the first end 96 and the second end 98, respectively. The first protrusion 100 and the second protrusion 102 also extend outward through the third slot 86 and the fourth slot 88, respectively. The first protrusion 100 and the second protrusion 102 and slidable within third slot 86 and the fourth slot 88, respectively, such that a position of the second divider 90 within the internal storage space 44 is adjustable. More specifically, the first protrusion 100 and the second protrusion 102 are slidable within the third slot 86 and the fourth slot 88, respectively, such that (i) a distance, $D_3$, between the second divider 90 and the first of the side walls 32 and (ii) a distance, $D_4$, between the second divider 90 and the second of the side walls 32 is adjustable.

A first set of rollers 104 and a second set of rollers 106 are rotatably secured to the first protrusion 100 and the second protrusion 102, respectively. Each of the first set of rollers 104 and the second set of rollers 106 may include two rollers. Alternatively, a single roller may be secured to the first protrusion 100 and the second protrusion 102. The first protrusion 100 (or a portion of the first protrusion 100) and the first set of rollers 104 are disposed on an opposing side of the front wall 28 relative to a central portion 108 of the second divider 90. The second protrusion 102 (or a portion of the second protrusion 102) and the second set of rollers 106 are disposed on an opposing side of the rear wall 30 relative to the central portion 108 of the second divider 90. If each of the first set of rollers 104 and the second set of rollers 106 includes two rollers, the two rollers of the of the first set of rollers 104 may straddle the second divider 90 at or along the first protrusion 100 and the two rollers of the of the second set of rollers 106 may straddle the second divider 90 at or along the second protrusion 102.

Each roller of the first set of rollers 104 is configured to glide and roll along the outwardly facing surface or exterior surface 70 of the front wall 28 between the first and second opposing sides walls 32 in order to adjust (i) the position of the second divider 90 within the internal storage space 44, (ii) the distance, $D_3$, between the second divider 90 and the first of the side walls 32, and (iii) the distance, $D_4$, between the second divider 90 and the second of the side walls 32. Each roller of the second set of rollers 106 is also configured to glide and roll along the outwardly facing surface or exterior surface 72 of the rear wall 30 between the first and second opposing sides walls 32 in order to adjust (i) the position of the second divider 90 within the internal storage space 44, (ii) the distance, $D_3$, between the second divider 90 and the first of the side walls 32, and (iii) the distance, $D_4$, between the second divider 90 and the second of the side walls 32.

The first rail 74 is also configured to guide the first set of rollers 104 along the exterior surface 70 of the front wall 28 between the opposing side walls 32. Stated in other terms, the first set of rollers 104 are configured to roll along or over the first rail 74 in the direction 78 that extends between the opposing side walls 32. The second rail 76 is configured to guide the second set of rollers 106 along the exterior surface 72 of the rear wall 30 between the opposing side walls 32. Stated in other terms, the second set of rollers 106 are configured to roll along or over the second rail 76 in the direction 78 that extends between the opposing side walls 32. Alternatively, third and fourth rails that are separate from the first and second rails 74, 76, respectively, may guide the first set of rollers 104 and second set of rollers 106.

Each roller of the first set of rollers 104 is configured to engage the exterior surface 70 of the front wall 28 and each roller of the second set of rollers 106 is configured to engage the exterior surface 72 of the rear wall 30 to maintain a substantially perpendicular alignment of the second divider 90 relative to the front wall 28, rear wall 30, and bottom wall 34. A third ridge 120 protrudes outward from the exterior surface 70 of the front wall 28 and a fourth ridge 122 protrudes outward from the exterior surface 72 of the rear wall 30. The third ridge 120 overhangs the first set of rollers 104 and the fourth ridge 122 overhangs the second set of rollers 106 such the tops of the first set of rollers 104 and tops of the second set of rollers 106 are restricted from reorienting by the third ridge 120 and fourth ridge 122, respectively. Stated in other terms, each roller of the first set of rollers 104 and each roller of the second set of rollers 106 are configured to rotate about axes 84 that are substantially perpendicular to the bottom wall 34. The first set of rollers 104 and the second set of rollers 106 are configured to engage the third ridge 120 and fourth ridge 122, respectively, so that the axes 84 axes remain in an orientation that is substantially perpendicular to the bottom wall 34. It is further noted that the second divider 90 has a substantially perpendicular alignment to the front wall 28, rear wall 30, and bottom wall 34 and that the engagement of the first set of rollers 104 with the third ridge 120 and the engagement of the second set of rollers 106 with the fourth ridge 122 facilitates maintaining the substantially perpendicular alignment of the second divider 90 to the front wall 28, rear wall 30, and bottom wall 34. Substantially perpendicular may refer to any incremental angle that is between exactly perpendicular and 15° from exactly perpendicular Including two rollers in each of the first set of rollers 104 and the second set of rollers 106 also prevents twisting of the second divider 90 within the third and fourth slots 86, 88 and prevents one of the first end 96 or the second end 98 of the second divider 90 from moving along direction 78 without the other of the first end 96 and the second end 98 also moving along direction 78. This arrangement also facilitates maintaining the substantially perpendicular alignment of the second divider 90 to the bottom wall 34. This arrangement further facilitates maintaining a substantially perpendicular alignment of the second divider 90 to the front wall 28 and rear wall 30, and a substantially parallel alignment of the second divider 90 to the opposing side walls 32. Substantially parallel may refer to any incremental angle that is between exactly parallel and 15° from exactly parallel. Substantially perpendicular may refer to any incremental angle that is between exactly perpendicular and 15° from exactly perpendicular.

Figure 6:
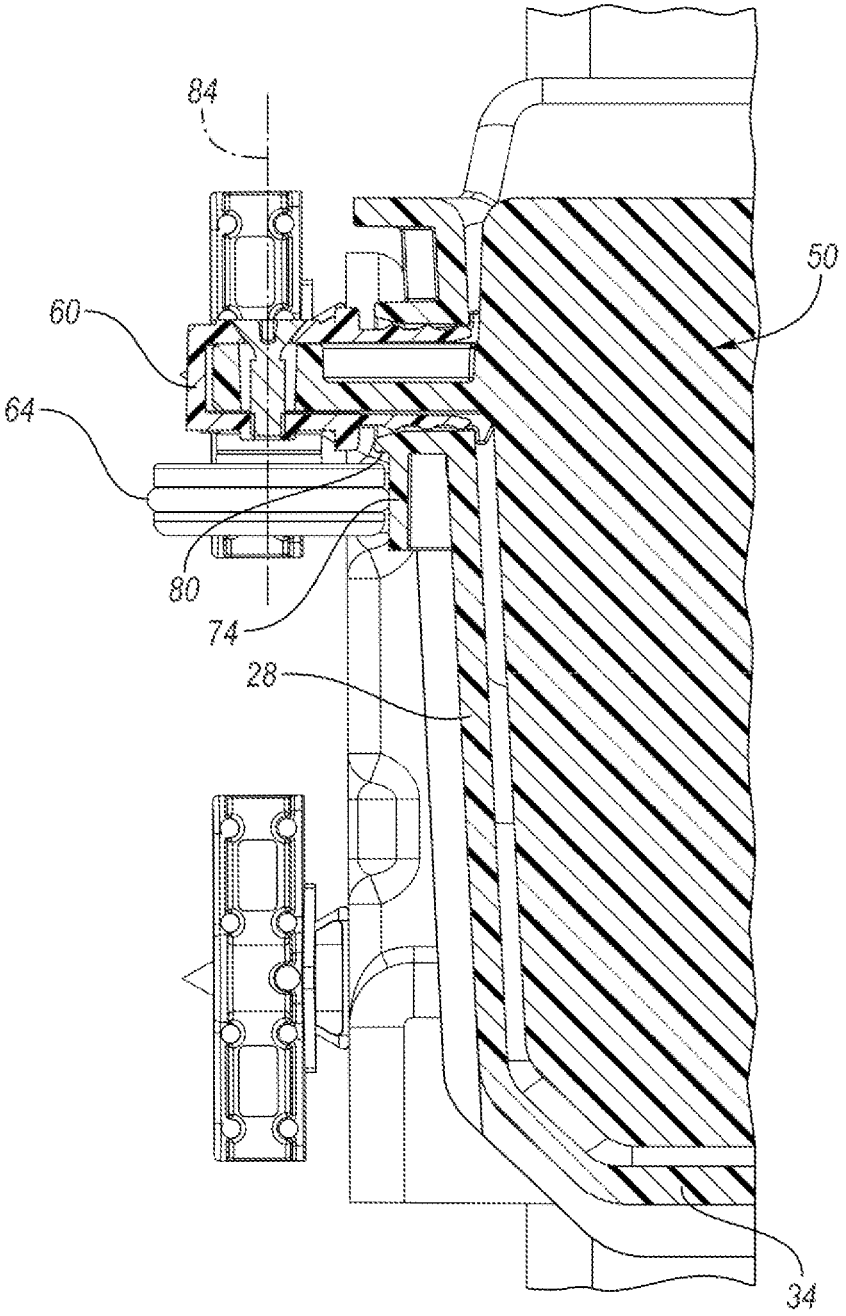
FIG. 6 is cross-sectional view taken along line 6-6 in FIG. 5.

It is noted that although the view in FIG. 6 illustrates the first protrusion 60 and the first set of rollers 64 of divider 50, FIG. 6 could also represent (i) the second protrusion 62 and the second set of rollers 66 of divider 50, (ii) the first protrusion 100 and the first set of rollers 104 of second divider 90, (iii) the second protrusion 102 and the second set of rollers 106 of second divider 90.

Figure 7:
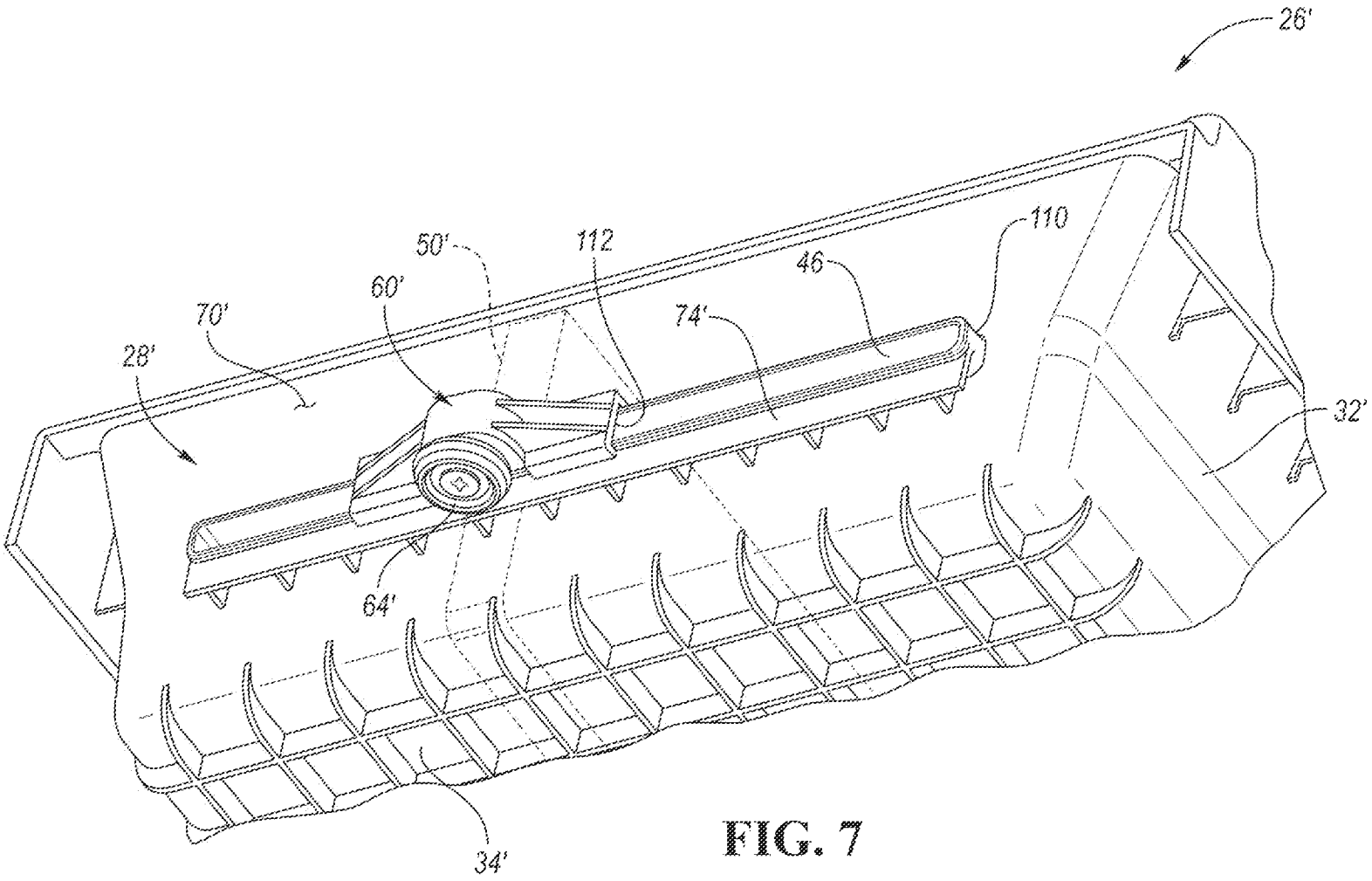
FIG. 7 is a partial front view of an alternative embodiment of the refrigerator drawer.

Referring to FIG. 7, an alternative embodiment of the refrigerator drawer 26' is illustrated. It should be understood that refrigerator drawer 26' has all the same subcomponents and functionality as refrigerator drawer 26 unless otherwise stated or illustrated herein. Furthermore, it should be understood that any component having a callout number in FIG. 7 that includes a prime symbol (') should be construed as having the same structure and functionality as a component illustrated in FIGS. 3-6 that includes the same callout number but without the prime symbol, unless otherwise stated or illustrated herein.

FIG. 7 more specifically illustrates a first protrusion 60' of a divider 50' that is extending through a slot 46' defined by a front wall 28' of the refrigerator drawer 26'. A roller 64' is secured to the protrusion 60'. The roller 64' is configured to glide along rail 74' between side walls 32'. The slot 46' is defined by a projection 110 that extends outward front the exterior surface 70' of the front wall 28'. The protrusion 60' defines a C-channel 112 that engages the projection 110 to guide the roller 64' between the side walls 32', to maintain a substantially perpendicular alignment of the divider 50' relative to the front wall 28', a rear wall of the refrigerator drawer 26', and a bottom wall 34' of the refrigerator drawer 26', and to maintain a substantially parallel alignment of the divider 50' to the side walls 32'. A correspond arrangement that is the mirror image of the arrangement in FIG. 7 may be disposed on the rear wall of refrigerator drawer 26'. Substantially parallel may refer to any incremental angle that is between exactly parallel and 15° from exactly parallel. Substantially perpendicular may refer to any incremental angle that is between exactly perpendicular and 15° from exactly perpendicular.

It is noted that components of the embodiment depicted in FIGS. 3-6 may be interchangeable with the embodiment depicted in FIG. 7. For example, the embodiment in FIGS. 3-6 may only include one divider wall and corresponding slot, the embodiment in FIGS. 3-6 may only include one wheel disposed on each protrusion of a divider, or the embodiment in FIGS. 3-6 may include the C-channel and projection arrangement of FIG. 7 to maintain alignment of a divider.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator drawer comprising:

a front wall;

a rear wall;

first and second opposing side walls extending between the front and rear walls, wherein the front wall and rear wall define first and second slots, respectively, each of the first and second slots extending between the first and second side walls;

a bottom wall interconnected with the front wall, rear wall, first side wall, and second side wall;

a divider extending between the front and rear walls, the divider having (i) a first surface facing the first side wall, (ii) a second surface facing the second side wall, (iii) first and second opposing ends disposed proximate to the front and rear walls, respectively, and (iv) first and second protrusions extending outward from the first and second ends and through the first and second slots, respectively;

first and second ridges (i) protruding outward from exterior surfaces of the front and rear walls, respectively, (ii) positioned below the first and second slots, respectively, and (iii) extending between the first and second opposing side walls;

first and second rails (i) protruding outward from the exterior surfaces of the front and rear walls, respectively, (ii) disposed below the first and second ridges, respectively, and (iii) extending between the first and second opposing side walls; and first and second rollers (i) attached to the first and second protrusions, respectively, (ii) extending downward from the first and second protrusions, respectively, (iii) disposed below the first and second ridges, respectively, (iv) configured to glide and roll along the first and second rails, respectively, between the first and second opposing side walls; and (v) configured to engage the first and second ridges, respectively, such that the first and second rollers are constrained to remain below the first and second ridges, respectively, and to maintain a substantially perpendicular alignment of the divider relative to the front and rear walls.

2. The refrigerator drawer of claim 1, wherein first and second rollers have rotational axes that are oriented substantially perpendicular to the bottom wall, and wherein the first and second rollers are configured to engage the first and second ridges, respectively, to maintain the orientation of the rotational axes.

3. The refrigerator drawer of claim 1 further comprising third and fourth rollers attached to the first and second protrusions, respectively, and configured to (i) glide and roll along the first and second rails, respectively, between the first and second opposing side walls and (ii) engage the first and second ridges, respectively, to maintain a substantially perpendicular alignment of the divider relative to the front and rear walls.

4. The refrigerator drawer of claim 3, wherein the first and third rollers straddle the divider along the first protrusion, and wherein the second and fourth rollers straddle the divider along the second protrusion.

5. The refrigerator drawer of claim 1, wherein the first and second slots are defined within first and second projections that extend outward from the exterior surfaces of the front and rear walls, respectively, and wherein the first and second protrusions define first and second C-channels that engage the first and second projections, respectively, to (i) guide the rollers between the first and second side walls and (ii) maintain a substantially perpendicular alignment of the divider relative to the front wall, rear wall, and bottom wall.

6. The refrigerator drawer of claim 1, wherein the front wall and rear wall define third and fourth slots, respectively, and further comprising:

a second divider extending between the front and rear walls, the second divider having (i) a third surface facing the first side wall, (ii) a fourth surface facing the second side wall, (iii) third and fourth opposing ends disposed proximate to the front and rear walls, respectively, and (iv) third and fourth protrusions extending outward from the third and fourth ends and through the third and fourth slots, respectively; and third and fourth rollers attached to the third and fourth protrusions, respectively, and configured to (i) glide and roll along first and second rails, respectively, between the first and second opposing side walls and (ii) engage third and fourth ridges, respectively, that extend from the front and rear walls, respectively, to maintain a substantially perpendicular alignment of the second divider relative to the front wall, rear wall, and bottom wall.

7. A refrigerator drawer comprising:

a front wall defining a first slot;

a rear wall (i) spaced apart from the front wall and (ii) defining a second slot that is substantially parallel to the first slot;

a first side wall extending between a first end of the front wall and a first end of the rear wall;

a second side wall (i) spaced apart from the first side wall and (ii) extending between a second end of the front wall and a second end of the rear wall;

a divider wall extending between the front and rear walls, the divider wall having first and second protrusions extending outward and through the first and second slots, respectively;

first and second ridges (i) protruding outward from exterior surfaces of the front and rear walls, respectively, (ii) positioned below the first and second slots, respectively, and (iii) extending between the first and second side walls;

first and second rails (i) protruding outward from the exterior surfaces of the front and rear walls, respectively, (ii) disposed below the first and second ridges, respectively, and (iii) extending between the first and second side walls; and first and second rollers (i) attached to the first and second protrusions, respectively, (ii) extending downward from the first and second protrusions, respectively, (iii) disposed below the first and second ridges, respectively, (iv) configured to roll along the first and second rails, respectively, between the first and second side walls to adjust distances between the divider wall and the first and second side walls, and (v) configured to engage the first and second ridges, respectively, such that the first and second rollers are constrained to remain below the first and second ridges, respectively, and to maintain a substantially perpendicular alignment of the divider wall relative to the front and rear walls.

8. The refrigerator drawer of claim 7 further comprising a bottom wall (i) interconnected with the front wall, rear wall, first side wall, and second side wall and (ii) substantially perpendicular to the front wall, rear wall, first side wall, and second side wall.

9. The refrigerator drawer of claim 7 further comprising third and fourth rollers (i) attached to the first and second protrusions, respectively, and (ii) configured to roll along the first and second rails, respectively, between the first and second side walls.

10. The refrigerator drawer of claim 9, wherein the first and third rollers straddle the divider wall along the first protrusion, and wherein the second and fourth rollers straddle the divider wall along the second protrusion.

11. A refrigerator drawer comprising:

a front wall defining a first slot;

a rear wall (i) spaced apart from the front wall and (ii) defining a second slot;

first and second opposing side walls each extending between the front and rear walls such that the front wall, rear wall, first side wall, and second side wall define an internal storage space;

an adjustable partition wall (i) disposed within the internal storage space and (ii) having first and second ends extending outward and through the first and second slots, respectively;

first and second ridges (i) protruding outward from exterior surfaces of the front and rear walls, respectively, (ii) positioned below the first and second slots, respectively, and (iii) extending between the first and second opposing side walls;

first and second rails (i) protruding outward from the exterior surfaces of the front and rear walls, respectively, (ii) disposed below the first and second ridges, respectively, and (iii) extending between the first and second opposing side walls; and first and second rollers (i) attached to the first and second ends on opposing sides of the front and rear walls relative to a central portion of the adjustable partition wall, respectively, (ii) extending downward from the first and second ends, respectively, (iii) disposed below the first and second ridges, respectively, (iv) configured to roll along the first and second rails, respectively, between the first and second opposing side walls to adjust distances between the adjustable partition wall and the first and second opposing side walls, and (v) configured to engage the first and second ridges, respectively, such that the first and second rollers are constrained to remain below the first and second ridges, respectively, and to maintain a substantially perpendicular alignment of the adjustable partition wall relative to the front and rear walls.

12. The refrigerator drawer of claim 11 further comprising third and fourth rollers (i) attached to the first and second ends, respectively, and (ii) configured to glide and roll along the first and second rails, respectively, between the first and second opposing side walls, wherein the first and third rollers straddle the adjustable partition wall along the first end, and wherein the second and fourth rollers straddle the adjustable partition wall along the second end.

13. The refrigerator drawer of claim 1, wherein the first and second ridges are connected to additional ridges forming closed loops that extend around peripheries of the first and second slots.

14. The refrigerator drawer of claim 1, wherein first and second rails have vertically oriented surfaces that engage the first and second rollers.

15. The refrigerator drawer of claim 7, wherein the first and second ridges are connected to additional ridges forming closed loops that extend around peripheries of the first and second slots.

16. The refrigerator drawer of claim 7, wherein first and second rails have vertically oriented surfaces that engage the first and second rollers.

17. The refrigerator drawer of claim 11, wherein the first and second ridges are connected to additional ridges forming closed loops that extend around peripheries of the first and second slots.

18. The refrigerator drawer of claim 11, wherein first and second rails have vertically oriented surfaces that engage the first and second rollers.

* * * * *